United States Patent [19]

Travis

[11] Patent Number: 4,585,159

[45] Date of Patent: Apr. 29, 1986

[54] COLLAPSIBLE CONTAINER AND FRAME

[75] Inventor: Claiborne L. Travis, Bogalusa, La.

[73] Assignee: Crown Zellerbach Corporation, San Francisco, Calif.

[21] Appl. No.: 724,728

[22] Filed: Apr. 18, 1985

[51] Int. Cl.[4] ..... B65D 5/12

[52] U.S. Cl. ..... 229/41 R; 150/49; 206/509; 220/71; 229/27; 229/39 R

[58] Field of Search ..... 220/71, 72.1, 84; 229/DIG. 11, 27, 39 R, 45 R, 41 R, 41 B, 52 B; 206/201, 202, 509; 150/49

[56] References Cited

U.S. PATENT DOCUMENTS

| | | | |
|---|---|---|---|
| 490,167 | 1/1893 | Schmidt | 229/39 R |
| 1,103,646 | 7/1916 | Baddeley | 229/41 R |
| 1,206,618 | 11/1916 | Thrasher | 220/84 |
| 1,666,333 | 4/1928 | Isoyama | 229/41 R |
| 1,706,814 | 3/1929 | Pfister | 229/41 R |
| 1,795,293 | 3/1931 | Boeye | 229/27 |
| 2,030,204 | 2/1936 | Gray | 150/49 |
| 2,224,537 | 12/1940 | Cowan | 150/49 |
| 2,279,247 | 4/1942 | Pope | 220/84 |
| 2,315,001 | 3/1943 | Logan | 150/49 |
| 2,355,946 | 8/1944 | Bitney | 206/202 |
| 2,361,603 | 10/1944 | Cohen et al. | 229/39 R |
| 2,398,166 | 4/1946 | Struensee | 220/84 |
| 2,600,439 | 6/1952 | Sloane | 150/49 |
| 2,739,754 | 3/1956 | Anderson, Jr. | 229/37 R |
| 2,746,668 | 5/1956 | Ringel et al. | 229/52 B |
| 2,778,560 | 1/1957 | Pfeiffer | 229/41 R |
| 4,299,365 | 11/1981 | Battle | 150/49 |
| 4,347,970 | 9/1982 | Nardone | 229/39 R |

*Primary Examiner*—William Price
*Assistant Examiner*—Gary E. Elkins
*Attorney, Agent, or Firm*—Thomas R. Lampe

[57] ABSTRACT

A collapsible container comprising two pairs of opposed walls, bottom flaps connected to the walls forming a container bottom, and lock panels connected to two of the bottom flaps and projecting into the interior of the container in abutting engagement. The container also includes a collapsible frame formed of pivotally interconnected rigid elements secured to the walls of the container and movable with the walls into a collapsed condition.

13 Claims, 14 Drawing Figures

COLLAPSIBLE CONTAINER AND FRAME

BACKGROUND AND SUMMARY OF THE INVENTION

This invention relates to a collapsible container, and more particularly, to a four sided box for accomodating and conveying articles therein.

Collapsible boxes are known in the art, such feature being considered advantageous in that storage and shipping space may be more effectively utilized.

Widespread usage of collapsible containers has, however, not taken place for many uses for two principal reasons. First of all, the very box features which allow the box to collapse often also weaken the box and render it unsuitable for the transport of heavy articles such as beverage bottles. The bottoms are particularly prone to failure. In addition, many prior art collapsible boxes have a relatively complicated structure, and can only be set-up and/or knocked-down through the expenditure of considerable time and effort by the party using the box.

The collapsible container of the present invention, by way of contrast, has an overall strength, including bottom strength, comparable to non-collapsible boxes constructed of the same type of material. In addition, the present container or box may be readily and quickly set-up and knocked-down—actually in the order of three of four seconds.

According to the present invention, a container is provided having two pairs of opposed walls interconnected along fold lines. Two pairs of bottom flaps are foldably connected to said walls, the bottom flaps of one pair having apertures therein and the bottom flaps of the other pair having locking portions positionable in the apertures to form a container bottom. Lock panels are connected to free edges of two of the bottom flaps and abut and bear against one another when the container bottom is formed to strengthen the bottom and help it resist failure. A collapsible frame member is attached to all of the walls to impart additional strength thereto. The frame member has rigid elements moveable with the walls when the container is collapsed so that such collapse will not be impeded when the box is knocked-down by its user.

DETAILED DESCRIPTION

Figure 1:
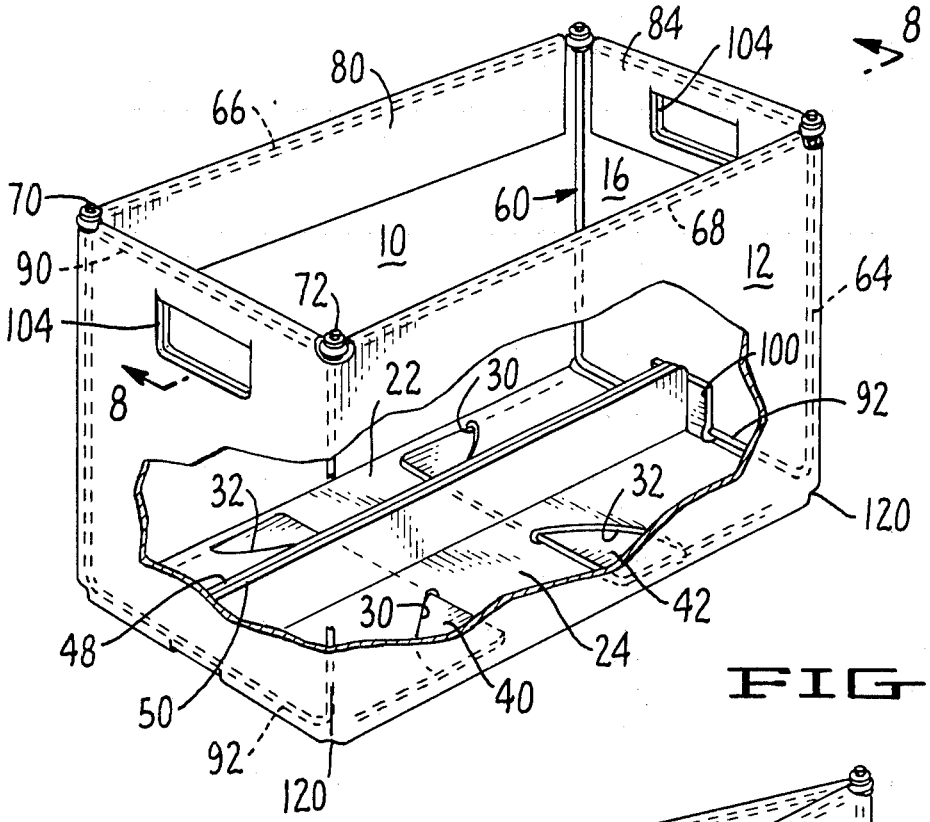
FIG. 1 is a perspective view of a preferred form of container constructed in accordance with the teachings of the present invention, and shown fully set-up and with selective portions broken away.
Figure 2:
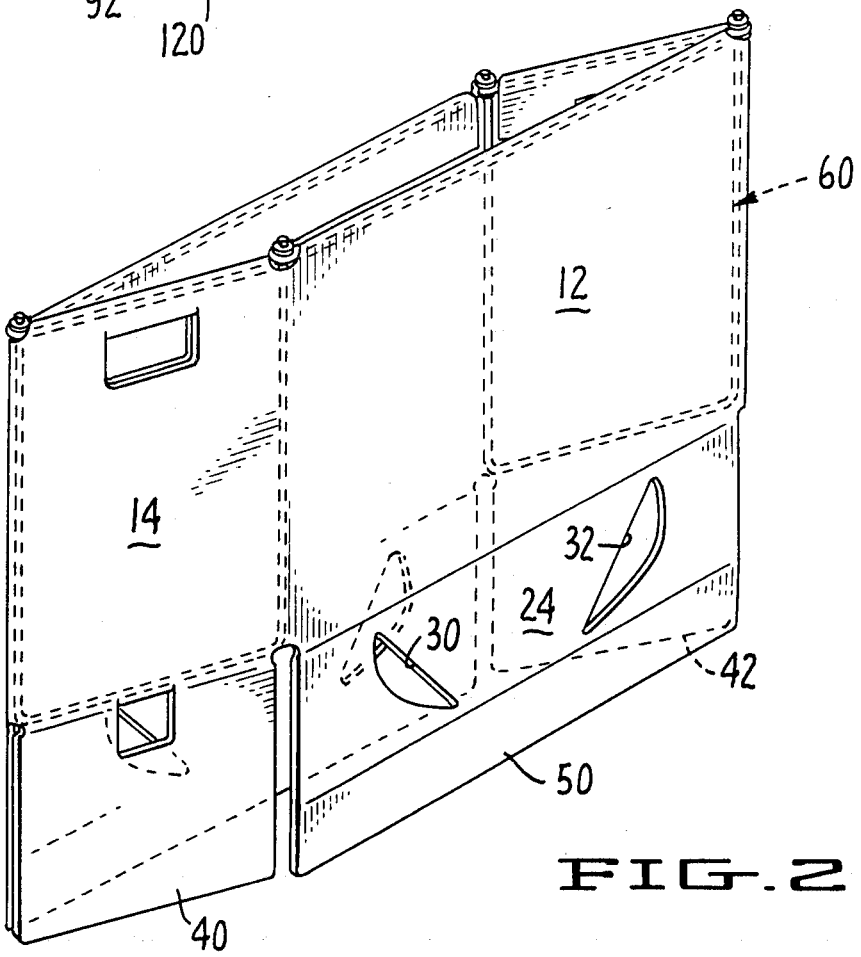
FIG. 2 is a perspective view of the container of FIG. 1 in a knocked-down condition.

FIG. 1 illustrates a container constructed in accordance with the teachings of the present invention in erected or assembled condition. Alternatively, such container may assume the collapsed condition illustrated in FIG. 2. As will be described in greater detail below, the container may be quickly and readily converted between these two conditions.

Figure 3:
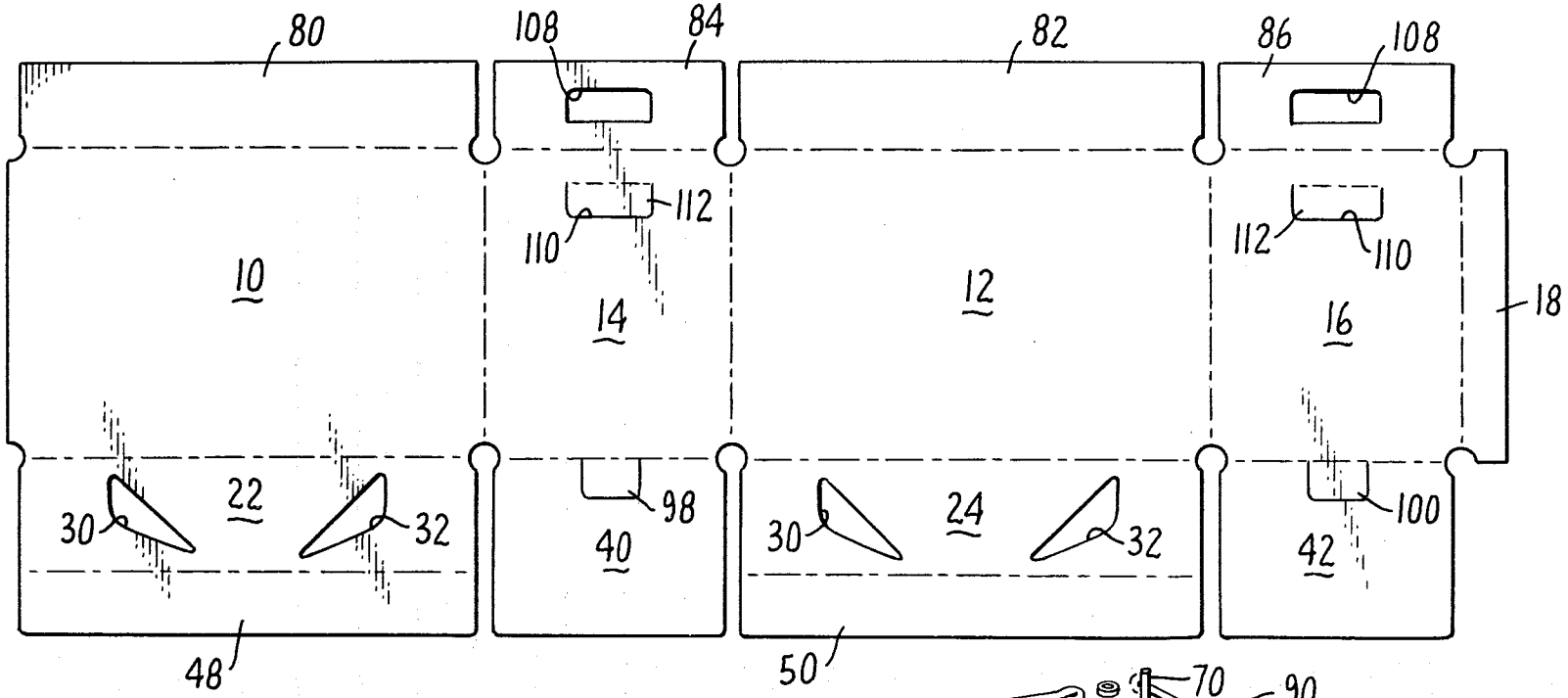
FIG. 3 is a plan view of a one-piece blank used to construct the container of FIG. 1.
Figure 4:
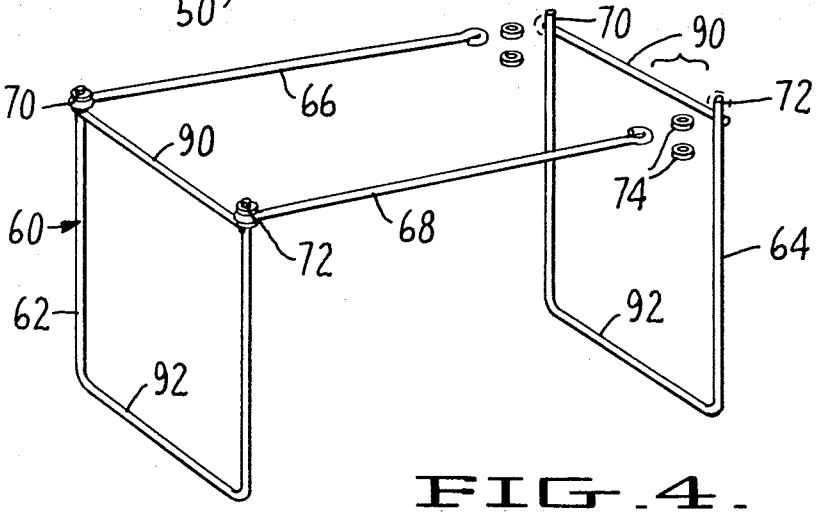
FIG. 4 is a partially exploded, perspective view of a frame member used in the construction of the container of FIG. 1.

The container is preferably formed from relatively stiff fiberboard cut to form the single piece blank illustrated in FIG. 3. The container includes a pair of opposed first walls 10, 12 and a pair of opposed second walls 14, 16 connected to the first walls along fold lines. The walls are secured together by a flap 18. Flap 18 is connected to wall 16 by a fold line and secured to wall 10 by any known expedient such as glue or staples.

First bottom flaps 22, 24 are hingedly connected to the first walls 10, 12, respectively, along hinge lines. The first bottom flaps define apertures 30, 32 therein, said apertures being spaced from one another in each first bottom flap and being generally in the shape of a hemi-oval.

Second bottom flaps 40, 42 are foldably connected to second walls 14, 16, respectively, along hinge lines. The outer free corners of the second bottom flaps comprise locking portions which are positionable in apertures 30, 32, in a manner to be described in greater detail below, to form a container bottom.

Each of the first bottom flaps has a lock panel connected thereto along a free edge thereof spaced from the hinge line connecting the first bottom flap to its associated first wall. The lock panel connected to first bottom flap 22 is identified by reference numeral 48 and the lock panel connected to first bottom flap 24 by reference numeral 50.

A collapsible frame member 60 is affixed to the container walls. The collapsible frame member includes a pair of generally rectangular-shaped rigid elements 62, 64 of a size and configuration generally corresponding to the configuration of second walls 14, 16. A pair of elongated rigid elements 66, 68 extends between elements 62, 64. The elongated rigid elements are attached at their ends to pivot posts 70, 72 located at adjacent corners of each of the rectangular-shaped rigid elements 62, 64. Washers 74 are preferably disposed on the pivot posts on opposed sides of the elongated rigid members at the locations of attachment of the ends to the pivot posts. The washers are secured to the pivot posts by any suitable known expedient, as by pinching the post end or welding. Except for the washers, all of the elements of the collapsible frame member are preferably formed from sturdy wire.

As has been previously stated, the elements of the collapsible frame member are secured to the container walls. Such attachment may perhaps best be seen with reference to FIGS. 8–11. A first set of securing flaps 80, 82 are attached along fold lines to first walls 10, 12, respectively. A second pair of securing flaps 84, 86 are in like manner connected along fold lines to second walls 14, 16, respectively.

After the frame member has been placed into position, securing flaps 80, 82 are folded over frame member elongated rigid elements 66, 68. Securing flaps 80, 82 are then glued, stapled or otherwise secured to first walls 10, 12 at locations spaced from the securing flap fold lines. Securing flaps 84, 86 are folded over the upper horizontally disposed legs 90 of elements 62, 64 between the pivot posts. Legs 90 are thus disposed between securing flaps 84, 86 and their respective second walls 14, 16. The securing flaps are affixed to the second walls to secure legs 90 in position. This may be done by glue, staples, etc.

Each of the generally rectangular-shaped rigid elements 62, 64 also has a second horizontal leg 92 spaced from and parallel to leg 90. Legs 92 are secured to second walls 14, 16 by auxiliary flaps 98, 100, folded over the legs and secured to the second walls.

Figure 5:
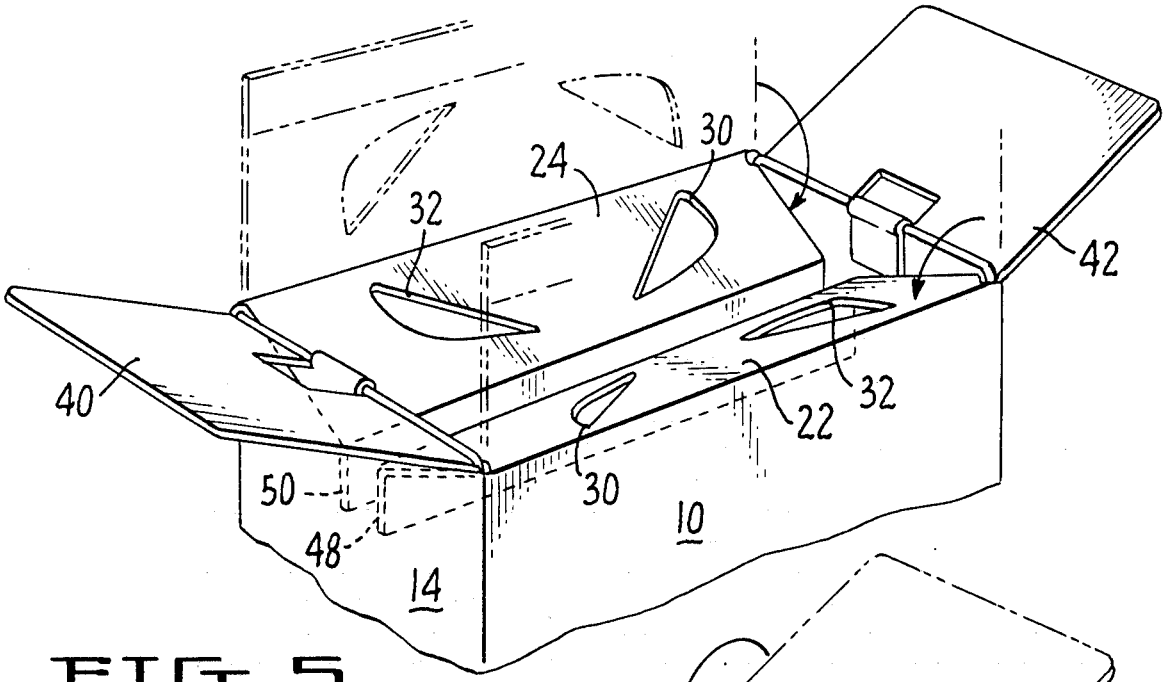
FIGS. 5, 6, and 7 are partial perspective views illustrating components of the container bottom during sequential stages of assembly.
Figure 6:
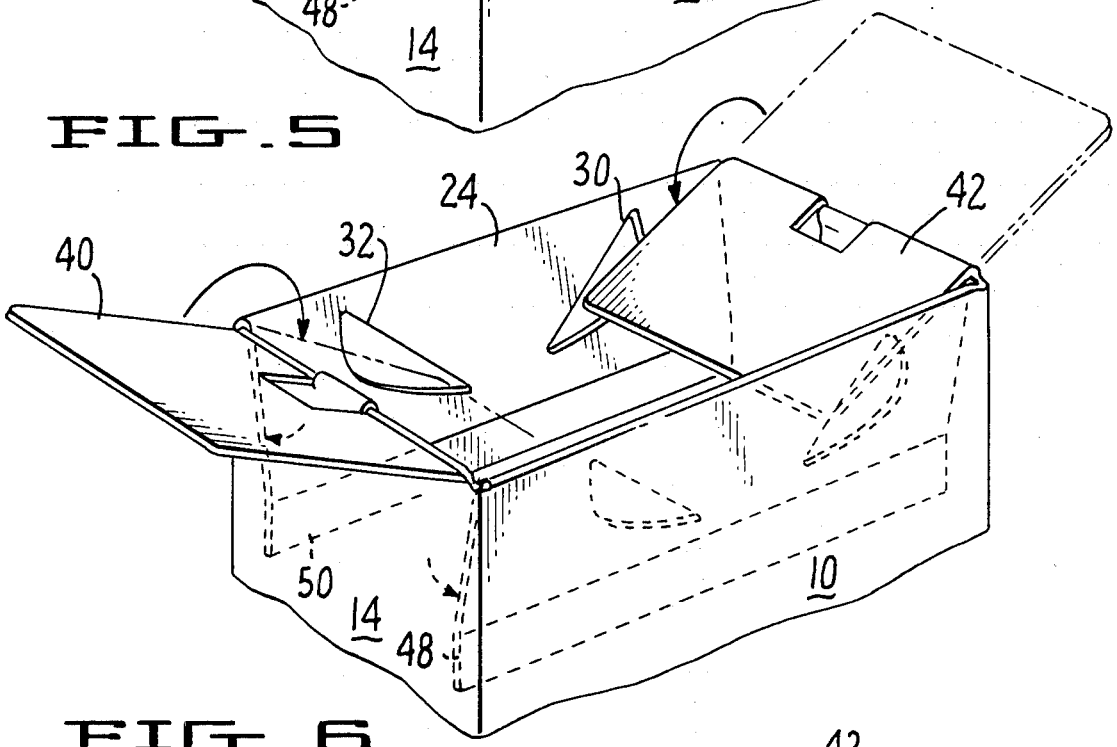
Figure 7:
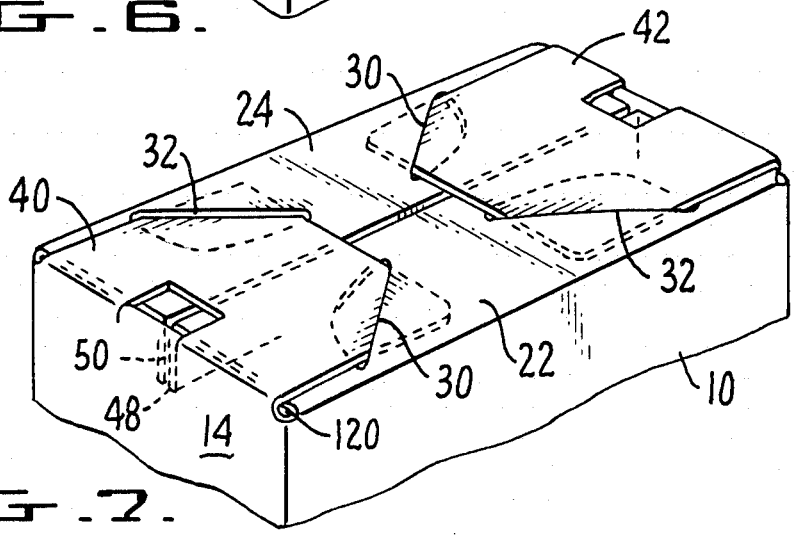
Figure 8:
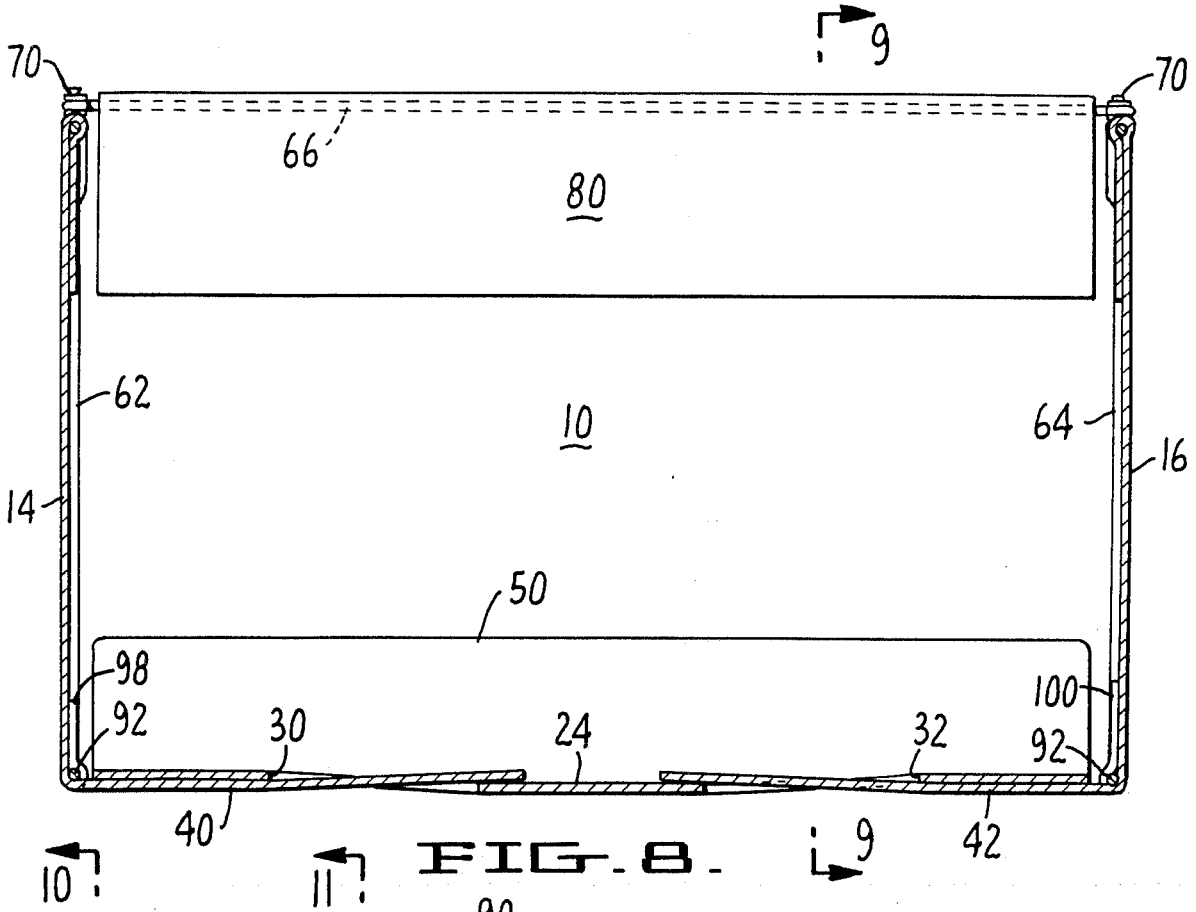
FIG. 8 is an enlarged cross-sectional view taken along line 8—8 in FIG. 1.
Figure 9:
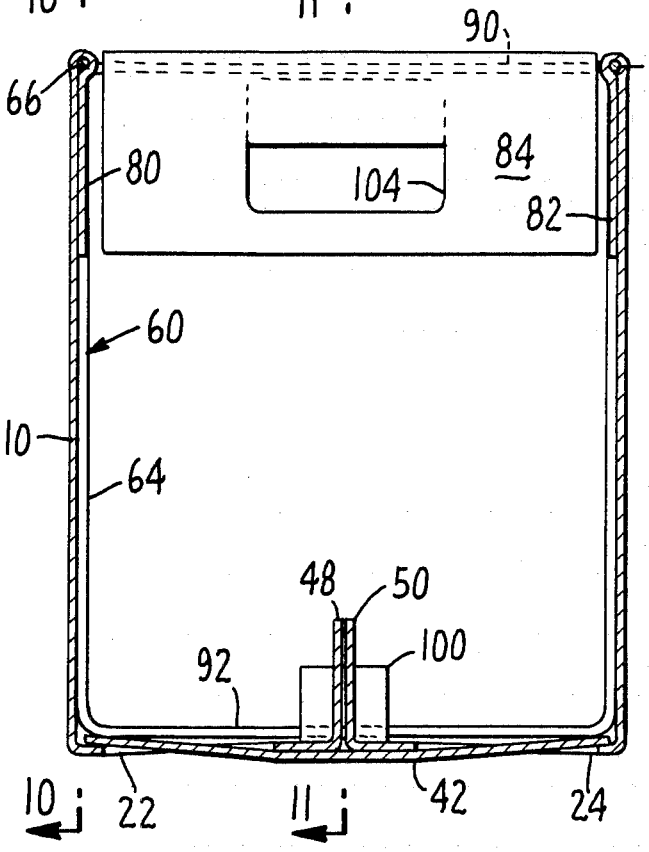
FIG. 9 is a cross-sectional view taken along line 9—9 in FIG. 8.
Figure 10:
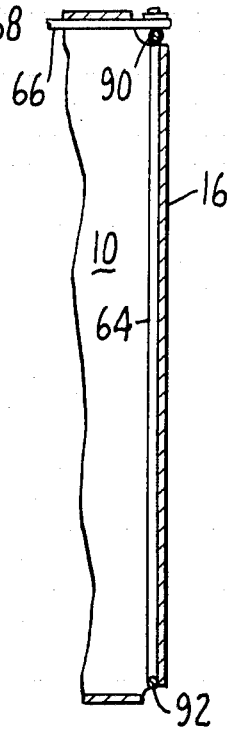
FIG. 10 is a cross-sectional view taken along line 10—10 in FIG. 9.
Figure 11:
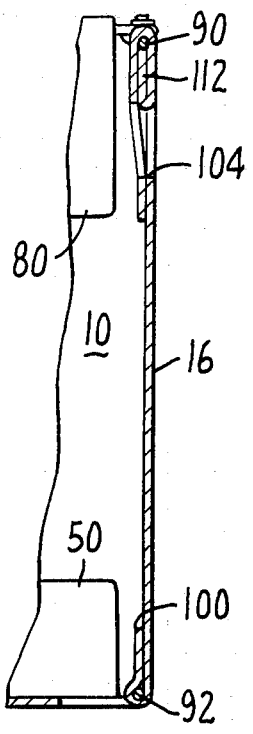
FIG. 11 is a cross-sectional view taken along line 11—11 in FIG. 9.

FIGS. 5, 6 and 7 show sequential steps involved in the formation of the container bottom. First, walls 10, 12, 14 and 16 are manipulated to form a generally rectangular configuration. Then, lock panels 48, 50 are folded so that they are generally perpendicular relative to the first bottom flaps 22, 24. First bottom flaps 22, 24 are then moved to the solid line positions illustrated in FIG. 5, with the lock panels 48, 50 extending into the interior of the container.

Next, second bottom flaps 40, 42 are folded over the first bottom flaps. The corners of the second bottom flaps are inserted into apertures 30, 32, as shown. Finally, the person assembling the container pushes first bottom flaps 22, 24 from underneath so that they are in face-to-face engagement with second bottom flaps 40, 42 and the locking portions, i.e. the outer free corners, of the second bottom flaps, are fully seated in the apertures.

It will be noted that when the bottom flaps are in the condition illustrated in FIGS. 1 and 7, the lock panels 48, 50 are disposed generally perpendicular to the first bottom flaps and in abutting engagement. The first and second bottom flaps and the lock panels cooperate to form a bottom which is very sturdy and secure, comparable in strength to solid container bottoms. Assembly may be accomplished in a matter of seconds. Likewise, knock-down of the assembled carton can be readily and promptly effected.

The frame member 60 obviously provides considerable strength and stability to the erected container. The frame member, however, because of the pivotal interconnection between its rigid elements, does not impede or resist either the erection of or the knock-down of the container.

Another feature of the container is noteworthy. The container preferably has hand holes 104 formed therein. The hand holes are created by holes 108 formed in securing flaps 84, 86 being placed in registry with holes 110 of a like configuration formed in second walls 14, 16. Holes 110 are defined by hole flaps 112 formed in the second walls. Hole flaps 112 are secured between the second walls 14, 16 and the securing flaps 84, 86; thus, a more comfortable hand hole is provided for the user. This feature also imparts strength to the hand hole as does the fact that legs 90 of the framework are disposed above the hand holes.

Figure 13:
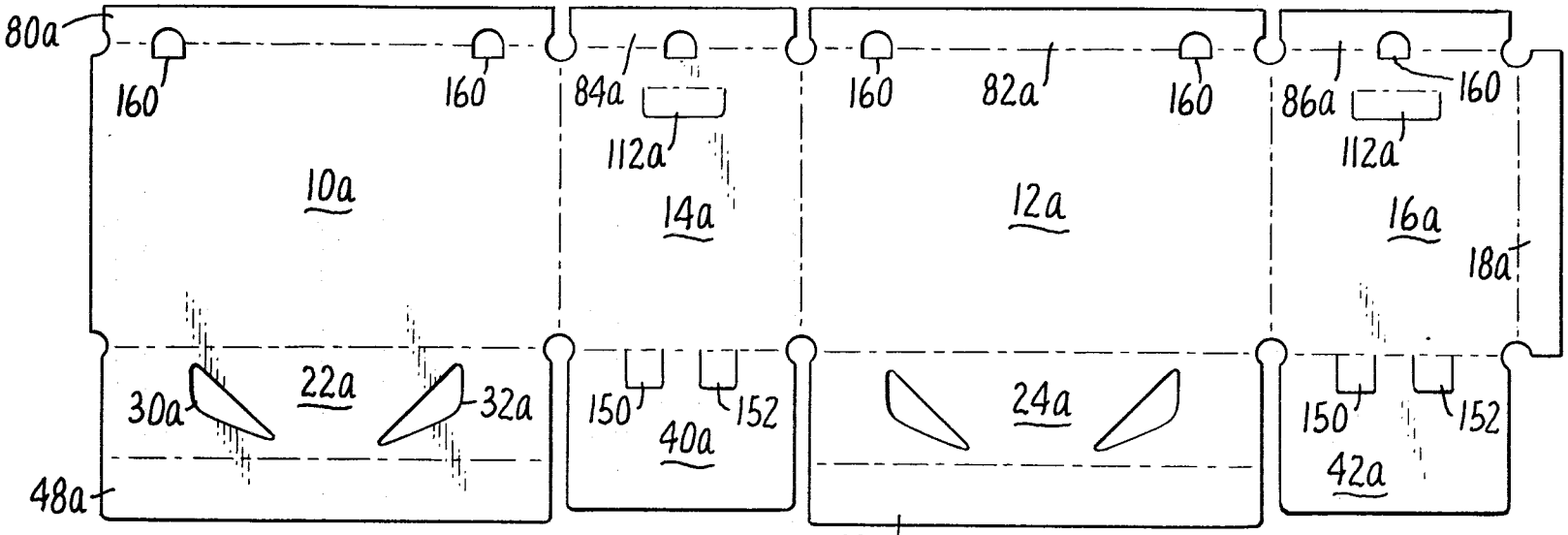
FIG. 13 is a plan view of a one-piece blank used to construct the container of FIG. 12.
Figure 14:
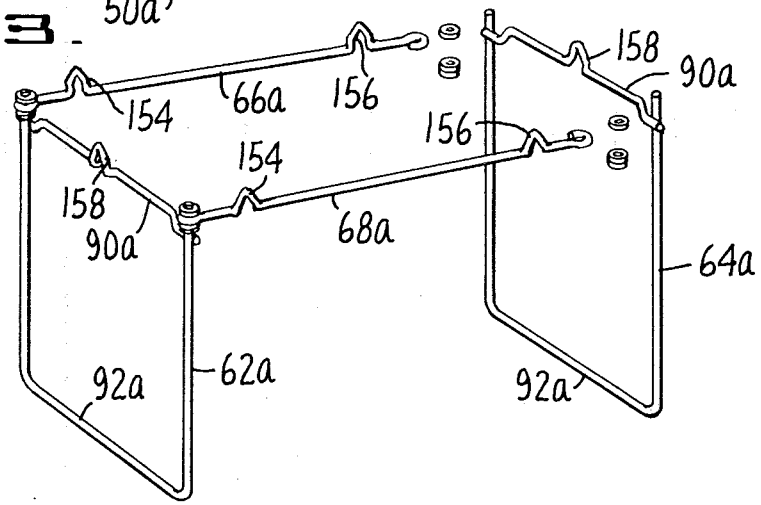
FIG. 14 is a partially exploded perspective view of a frame member used in the contruction of the container of FIG. 12.
Figure 12:
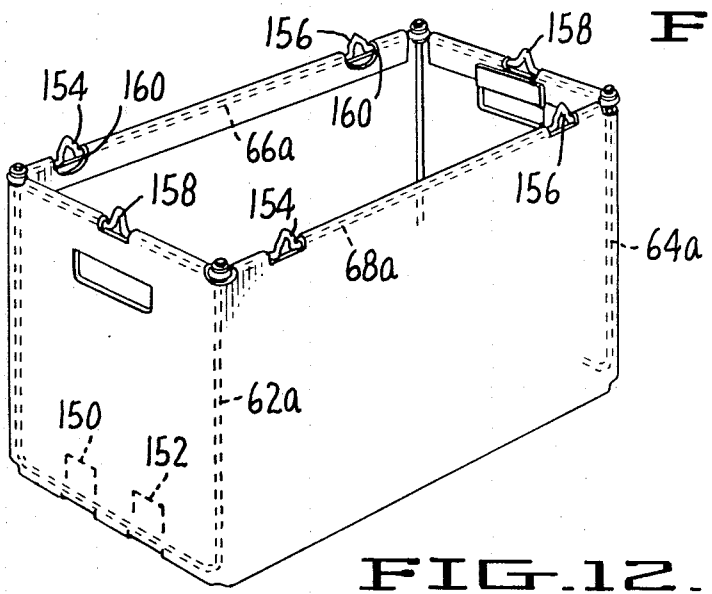
FIG. 12 is a perspective view of an alternative preferred form of container constructed in accordance with the teachings of the present invention, and shown fully set-up.

An alternative form of container constructed in accordance with the teachings of the present invention is shown in FIGS. 12–14. In many respects, this form of container is similar in construction to that shown in FIGS. 1–11 and for purposes of simplicity like components carry corresponding reference numbers (with the letter a modifier) and will not again be described.

The principal differences between the container construction described above and this alternative container are as follows.

The alternative container second bottom flaps **40*a*, 42*a* each have associated therewith two spaced auxiliary flaps 150, 152. These spaced auxiliary flaps 150, 152 are folded over legs 92*a* of elements 62*a*, 64*a* and secured to second walls 14*a*, 16*a* to maintain legs 92*a*** in position.

The frame member **60*a* itself is modified in several respects. Elongated rigid elements 66*a*, 68*a* each have formed at the outer extremities thereof upwardly projecting bight elements 154, 156. Similarly, upwardly projecting bight elements 158 are formed in legs 90*a* substantially mid-length thereof. These upwardly projecting bight elements are, as perhaps may best be seen with reference to FIG. 13, adapted, when the container is assembled, to project upwardly through apertures 160 along the line of juncture between first and second walls 10*a*, 12*a*, 14*a*, 16*a* and securing flaps 80*a*, 82*a*, 84*a*, 86*a***. The upwardly projecting bight elements are preferably offset outwardly, and thus may be used to provide stacking stability by engaging the walls of a like container positioned above. Alternatively, the bight elements may extend vertically or be offset inwardly and positionable in correspondingly placed apertures (not shown) formed in the container bottom.

In this alternative version of the container, hole flaps **112*a* of second walls 14*a*, 16*a* are positioned further away from securing flaps 84*a*, 86*a* than is the case with the originally described embodiment. Flaps 112*a* do not enter into hand holes formed in the securing flaps; rather, the securing flaps are narrower and terminate just above the hinge of the flaps. Thus, when the flaps 112*a* are pushed inwardly, they engage securing flaps 84*a*, 86*a*** and the elements cooperate to provide carrying strength.

I claim:

1. A collapsible container comprising:

a pair of opposed first walls;

a pair of opposed second walls connected to said first walls along fold lines, said walls being selectively moveable about said fold lines to bring said walls into face-to-face engagement;

first bottom flaps hingedly connected to said first walls along hinge lines and defining apertures therein;

second bottom flaps hingedly connected to said second walls and having locking portions positionable in said first bottom flap apertures to form a container bottom;

a lock panel connected to each of said first bottom flaps along a free edge of the first bottom flap, said free edge being spaced from the hinge line connecting the first bottom flap to its associated first wall, the lock panels being disposed generally perpendicular to said first bottom flaps and in abutting engagement when said locking portions are positioned in said apertures to form said container bottom, said first and second bottom flaps and said abutting lock panels being cooperable to prevent said walls from moving into face-to-face engagement; and a collapsible frame member formed of pivotally interconnected rigid elements affixed to said walls, means for securing one of said rigid elements of said frame member to each of said walls so that each rigid element is moveable with said walls into collapsed condition when said container is collapsed.

2. The container of claim 1 wherein each wall is of a generally rectangular configuration and wherein said collapsible frame member includes a pair of generally rectangular-shaped rigid elements of a size and configuration generally corresponding to the configuration of said second walls and secured to said second walls about the periphery thereof.

3. The container of claim 2 wherein said collapsible frame member further includes a pair of elongated rigid elements extending along said first walls, said elongated rigid elements being pivotally attached at the ends thereof to said generally rectangular-shaped rigid elements.

4. The container of claim 2 comprising securing flaps connected to said walls along flap fold lines, said securing flaps being secured to said walls at locations spaced from said flap fold lines, and said rigid elements extending between said securing flaps and said walls and secured to said walls by said securing flaps.

5. The container of claim 4 wherein auxiliary flaps extend from each of said second walls at locations spaced from said securing flaps to affix said generally rectangular-shaped rigid elements to said second walls at the bottoms thereof.

6. The container of claim 4 wherein said second walls define holes at the upper ends thereof, said holes being disposed in alignment with holes formed in securing flaps connected to said second walls to form multiple thickness hand holes.

7. The container of claim 6 wherein a portion of each said generally rectangular-shaped rigid element is positioned between a securing flap and a second wall above a hand hole.

8. The container of claim 1 wherein each said first bottom flap defines two apertures therein, said apertures positioned on opposite sides of said abutting lock panels when said container bottom is formed.

9. The container according to claim 8 wherein said apertures are generally in the shape of a hemi-oval.

10. The container of claim 6 additionally comprising a hand hole flap secured between each second wall and the securing flap connected thereto.

11. A single piece blank for making the container of claim 1.

12. The container of claim 1 wherein upwardly projecting bight elements are formed in at least some of the rigid elements of said frame member to facilitate stacking of said containers.

13. The container of claim 4 wherein hand hole flaps are formed in said second walls, said flaps being engageable with securing flaps connected to said second walls.

* * * * *